US010480134B1

(12) United States Patent
Frost et al.

(10) Patent No.: US 10,480,134 B1
(45) Date of Patent: Nov. 19, 2019

(54) HAND HELD SCREED RAKING DEVICE FOR APPLYING PAVING MATERIAL TO A SURFACE

(71) Applicants: Stuart Anthony Frost, Powell, WY (US); David Michael Frost, Jr., Powell, WY (US)

(72) Inventors: Stuart Anthony Frost, Powell, WY (US); David Michael Frost, Jr., Powell, WY (US)

(73) Assignee: Axenox Corp., Powell, WY (US)

( * ) Notice: Subject to any disclaimer, the term of this patent is extended or adjusted under 35 U.S.C. 154(b) by 0 days.

(21) Appl. No.: 16/548,827

(22) Filed: Aug. 22, 2019

(51) Int. Cl.
*E01C 19/48* (2006.01)
*E01C 19/44* (2006.01)
*E04F 21/24* (2006.01)

(52) U.S. Cl.
CPC ..... *E01C 19/44* (2013.01); *E04F 21/241* (2013.01)

(58) Field of Classification Search
CPC ..... E01C 19/44; E04F 21/241
USPC ..... 404/89, 93, 118; 15/235.5
See application file for complete search history.

(56) References Cited

U.S. PATENT DOCUMENTS 3,595,143 A * 7/1971 Polselli ..... E01C 19/43 404/93
3,703,857 A * 11/1972 MacKinnon ..... E01C 19/43 404/93
4,070,128 A * 1/1978 Garrison ..... E01C 19/43 15/144.4
4,230,356 A * 10/1980 O'Connor ..... E04F 21/165 15/235.3
4,650,366 A * 3/1987 Morrison ..... E04G 21/10 404/114
4,822,209 A * 4/1989 Dragich ..... E01C 23/026 404/89
5,236,277 A * 8/1993 Hybertson ..... E01C 19/43 249/52
5,609,437 A * 3/1997 Silva ..... E01C 19/44 15/235.4
5,727,279 A * 3/1998 Pike, Jr. ..... E01C 19/44 15/235.4
5,857,803 A * 1/1999 Davis ..... E01C 19/38 15/235.4

(Continued)

*Primary Examiner* — Raymond W Addie
(74) *Attorney, Agent, or Firm* — MacBride Law, PLLC; William L. MacBride, Jr.

(57) ABSTRACT

A hand held screed raking device having a longitudinally extending screed head, arced dozer front face, screed back, and tubular rake handle or rake grip handle. An underside shoe secures against the longitudinally extending screed head, connecting to a longitudinal bottom trailing surface, having a smooth, or textured bottom surface with repetitive or variable form and different forms of textured bottom surfaces. The textured bottom surface may dampen in amplitude, and be oriented with respect to application material applying direction. The user dozes pushing or pulling the device over a surface, loading application material along the arced dozer front face applying it on the surface. The invention leaves a less segregated application material on the surface, by allowing it to be controlled by pitching the angle of the longitudinal bottom trailing surface, and making smooth grade adjustments. The invention uses different application materials in various industries.

27 Claims, 12 Drawing Sheets

(56) References Cited

U.S. PATENT DOCUMENTS

| | | | | |
|---|---|---|---|---|
| 6,231,331 | B1 * | 5/2001 | Lievers | E01C 19/402 404/114 |
| 8,016,517 | B1 * | 9/2011 | Pardue | B25G 1/04 15/143.1 |
| 8,277,144 | B1 * | 10/2012 | Bayley | E01C 19/44 15/235.4 |
| 8,684,627 | B2 * | 4/2014 | Shaw | E04F 15/12 15/235.6 |
| 2002/0157203 | A1 * | 10/2002 | Aguilera | E01C 19/42 15/235.4 |
| 2005/0172432 | A1 * | 8/2005 | Sullivan | E04F 21/00 15/105 |
| 2006/0133896 | A1 * | 6/2006 | Schmitt | E01C 19/402 404/118 |
| 2006/0137125 | A1 * | 6/2006 | Goller | E04F 21/163 15/235.4 |
| 2007/0206991 | A1 * | 9/2007 | Brotzel | E01C 3/06 404/118 |
| 2008/0104788 | A1 * | 5/2008 | Wothers | E04F 21/244 15/235.8 |
| 2008/0313837 | A1 * | 12/2008 | Carta | E04F 21/06 15/235.4 |
| 2009/0217476 | A1 * | 9/2009 | Hurley | B25G 3/12 15/235.8 |
| 2014/0115804 | A1 * | 5/2014 | Propst | E04F 21/24 15/235.6 |
| 2014/0123425 | A1 * | 5/2014 | Harper | E04F 21/163 15/235.4 |
| 2015/0026907 | A1 * | 1/2015 | Couch | E04F 21/241 15/245.1 |
| 2016/0138282 | A1 * | 5/2016 | Pereyra | E04F 21/163 15/235.8 |

* cited by examiner

HAND HELD SCREED RAKING DEVICE FOR APPLYING PAVING MATERIAL TO A SURFACE

FIELD OF THE INVENTION

This patent disclosure relates to a handheld screed raking device, or screed rake, for applying material to a surface.

BACKGROUND OF THE INVENTION

Hand tools having variated working surfaces for shaping and spreading concrete, glue, or other viscous materials are common in the industry. However, there has been a recognized need, such as in the road paving industry, for providing screed plates with differing textures to the underside screed or working surface. These application, viscous, materials include various substances, such as grout for tiling, asphalt for a road surface, or landscaping material for a lawn. A need has been recognized in the industry for hand tools, such as a rake or trowel device that could lay material on a smoother grade without segregating it into constituent sizes, in a comfortable and an easy to operate design.

Additionally, it has been recognized that a variable or repetitive, wave-like pattern or other textured pattern or form to the underside, working surface, to the rake device is needed for varying application techniques and types of material to be applied to a surface. The closest technology found would be a typical asphalt rake/lute, or a landscaping rake, both of which lacking the ability to lay a significant amount of varied, viscous material in a homogeneous, non-segregated manner.

In the asphalt paving industry, the current standard in asphalt rakes are those made of aluminum or a combination of aluminum and magnesium. Because these metals have a high thermal conductivity, the rakes cool rapidly while raking the hot asphalt making the asphalt stick easier to the rake and the application of such material to a surface very difficult. A need for a device with a lower thermal conductivity is recognized for use with such material. As well, a need for a less conductive handle to such a device is desirable since the rake or trowel device is hand held when used.

The references described in the related art do not disclose features of the present invention and would not be as suitable for the required purpose of the present invention hereinafter described. Hand-held rake devices for spreading or applying materials are found in the related art, exemplified by U.S. Pat. No. D621,236 to Bahler et al. (collectively, "Bahler"), U.S. Pat. No. 7,281,878 to Schulz ("Schulz"), and U.S. Pat. No. 3,119,138 to Davis ("Davis"). Bahler discloses a dozer shaped screed design that is convex shaped face for applying material, facing forward from a user, and comprises four separate planar surfaces extending longitudinal, from end to end. Although Bahler discloses a face having a "dozer type" configuration formed by four distinctly angled surfaces, it does not disclose or teach the bottom portion, underside shoe or other elements of the present invention.

None of the references found today show hand tools having a working surface or underside shoe that is wave shaped or textured in cross section, having the height or amplitude of the working surface, underside shoe or trailing surface, and/or decreasing in size for the leading edge of the device to the trailing edge. Davis discloses a working surface that is uniform in size and shape, including a wave-like pattern; however, the shape. configuration of the "wave" in cross section, as well as the manner of operation, is dissimilar from the present invention. As well, the height or amplitude of the form in the prior art does not decrease in size from a leading edge to a trailing edge on the underside surface.

None of the prior art references found render the present invention obvious. The concave configuration or dozer arced face of the present invention comprising the front face, the textured or variable wave configuration provided on the bottom surface and the underside shoe are neither disclosed or suggest by the prior art. Although Schulz discloses using random spacing and depth of repeating v-shaped grooves, this reference does not suggest, teach or support modifying Davis or any other reference in a manner that would suggest a cresting wave pattern or other texture profile that decreases in depth or height (amplitude) for a leading edge to a trailing edge, or would otherwise function in the manner of the present invention.

None of the references in the prior art contain every feature of the present invention, and none of these references in combination disclose, suggest or teach every feature of the present invention. The present invention is neither disclosed nor suggested by the prior art.

The foregoing and other objectives, advantages, aspects, and features of the present invention will be more fully understood and appreciated by those skilled in the art upon consideration of the detailed description of a preferred embodiment, presented below in conjunction with the accompanying drawings.

SUMMARY OF THE INVENTION

The present invention is a hand held screed raking device which comprises a longitudinally extending screed head, the longitudinally extending screen includes an arced dozer front face, a screed back, and an angularly attached bottom plate. The arced dozer front face may a concavely arced face or a convexly arced face. The arced dozer front face acutely and downwardly connects to the angular bottom plate at an arc/bottom contact point, terminating at a screed head cooperating toe securing end, and oppositely and upwardly connects to the screed back at an arc/back contact point. The arced dozer front face, the screed back, and the angular bottom plate form a generally triangular cross sectional shape to the longitudinally extending screed head.

In alternative embodiments of the present invention, an underside shoe conformably, cooperatively secures against the angular bottom plate and comprises an upwardly angled leading surface, a shoe back end and an opposing shoe toe securing end. The underside shoe connects with, and abuts against, the arced dozer front face and arcs downward and rearward, connecting to a longitudinal bottom trailing surface. The longitudinal bottom trailing surface continues rearward laterally and terminates at the shoe back end and is defined as the entire bottom working surface of the underside shoe.

The handle held screed device further comprises a tubular rake handle which freely and securely attaches to and engages the longitudinally extending screed head by a rake handle attaching means. An upper head portion comprises an upper back panhandle, adjoining the screed back and the arced dozer front face and in n an alternative embodiment, an upper back slot is located at the opposing panhandle end and securely accommodates a removably protruding wear protective surface strip.

The underside shoe freely, securely and removably attaches against the angular bottom plate by an at least one shoe attaching means, allowing the underside shoe to be removable. In another alternative embodiment, a screed head cooperating heel securing notch may be located immediately and vertically above a shoe back end, removably and securely houses a removable shoe heel wear protective surface strip.

The longitudinal bottom trailing surface of alternative embodiments of the comprises one of a smooth bottom surface or a textured bottom surface. The textured bottom surface comprises at least one of: a repetitive form, a variable form The textured bottom surface may be any one of a wave form bottom surface; a v-shaped bottom surface; a block shaped bottom surface; or other form of textured bottom surface; and may, flattens and dampens in amplitude or wave height. and is oriented in the applying direction conducted by a user. In alternative embodiments, the textured bottom surface may be oriented with respect to the applying direction of the user as to its primary wave or form orientation in one of parallel, perpendicular, or at an acute angle direction.

The user is spreading, screeding, moving or applying (generally termed, "moving" or "applying" herein) and dozing the application material by grasping and using the hand held screed raking device by the tubular rake handle and pushing or pulling the hand held screed device over a surface. The application material gathers and loads along the arced dozer front face. The arced dozer front face keeps the longitudinally extending screed head from lifting upward as the hand held screed raking device simultaneously and homogeneously applies, screeds, and compacts the application material onto the surface in an applying direction as traversed by the user. The application material applied to the surface and may be glue laminates, asphalt, cement, tile and floor grout, mortar, landscaping topsoil, gravel, aggregate, mulch, dirt, or other surface treatment material.

The textured bottom surface enables larger aggregates of application material to be moved or travel more easily underneath the hand held screed raking device and intermix in a homogeneous manner to discourage any segregation of particle size of the application material on the surface. The tubular rake handle, as well as the rake grip handle, in an alternative embodiment, are formed from material which is less thermally conductive or non-conductive than in prior art.

In an alternative embodiments of the present invention, the hand held screed raking device comprises a longitudinally extending screed head having a convexly arced dozer front face, a screed back, and a longitudinal bottom trailing surface. The convexly arced dozer front face acutely connects to and terminates downwardly at the longitudinal bottom trailing surface at an arc/bottom contact point and oppositely and acutely upwardly connects to the screed back at an arc/back contact point. The longitudinal bottom trailing surface oppositely and acutely connects to the screed back at a back/bottom contact point. In this configuration thereby, the convexly arced dozer front face arcs downward to the arc/bottom contact point. The rake grip handle attaches to the longitudinally extending screed head midway vertically down and centrally on the screed back, and the user grasps the hand held screed raking device by the rake grip handle to hand doze application material which gathers and loads along the arced dozer front face, and the hand held screed raking device simultaneously and homogeneously applying, screeding, and compacting the application material onto a surface in a non-segregating manner and in an applying direction as traversed by the user.

The hand held screed raking device is a hand held tool for spreading, screeding, moving or applying application material, including viscous material such as asphalt, concrete, grout, glue, or landscape materials such as dirt; utilizing either the smooth bottom surface, the group of textured bottom surface forms or other textured bottom surface forms, to help discourage application material segregation when the user moves and applies the application material to the surface.

The longitudinal bottom trailing surface is operated similar to any hand held rake or trowel with the added control in the present invention of pitching the screed surface angle of attack, defined by the upwardly angled leading surface, to control application material grade during use in the applying direction. The arced dozer front face more evenly distributes the application material being laid or spread out by the user in the applying direction while leaving a better, less segregated application material on the surface, by allowing the "floating screed", the application material, to be controlled by pitching the angle of attack of the longitudinal bottom trailing surface. By adjusting the vertical angle of attack, the user can make smooth grade adjustments while spreading, in the applying direction, the application material being raked or applied. As the application material travels in the applying direction under the longitudinal bottom trailing surface, it is compacted, leaving a better finish on the surface without the segregation of portions of the application material. By using a unique variable wave design, such as a wave form bottom surface, the application material, such as aggregate, may be evenly spread and compacted on the surface in a homogenous fashion, and allows larger aggregates to move more easily under the longitudinally attached bottom trailing surface, further discouraging segregation by compacting the larger aggregate being laid into the surface.

In alternative embodiments of the present invention, the longitudinally extending screed head may be comprised of one or more of the following: aluminum, plastic, or other durable and lightweight material preventing hotter application material from sticking to the hand held screed raking device as easily as with commonly known screed raking devices, and preventing wetter application material from freezing and sticking.

Another advantage is the ease of use allowing different handle pitch options for taller users with the hand held screed raking device. Use of the hand held screed raking device is not limited to or specific to any one industry, and may be used in the paving industry, concrete industry, construction industry, landscaping industry, as well as other industries where the use of such hand held equipment for applying application material is required, allowing a user to more easily obtain an acceptable grade of application material without the segregation problems that are inherent to current rakes found in different industries, and spread a multitude of application materials, including, but not limited to, aggregates and aggregate mixtures, soils, landscaping materials; and in a number of applications, such as for distributing glue or grout, patching asphalt, for preparing subgrade surfaces, and for tiling or finishing surfaces, and other surface application activities.

The aforementioned features, objectives, aspects and advantages of the present invention, and further objectives and advantages of the invention, will become apparent from a consideration of the drawings and ensuing description.

BRIEF DESCRIPTION OF THE SEVERAL VIEWS OF THE DRAWINGS

The foregoing features and other aspects of the present invention are explained and other features and objects of the present invention will become apparent in the following detailed descriptions, taken in conjunction with the accompanying drawings. However, the drawings are provided for purposes of illustration only, and are not intended as a definition of the limits of the invention.

FIG. 1A illustrates Detail C, an elevated side blow-up and cutaway view of an at least one shoe attaching means, depicting the following elements:

at least one threaded tapped bottom hole, at least one shoe hole, and at least one attaching bolt for securing the underside shoe.

Figure 2:
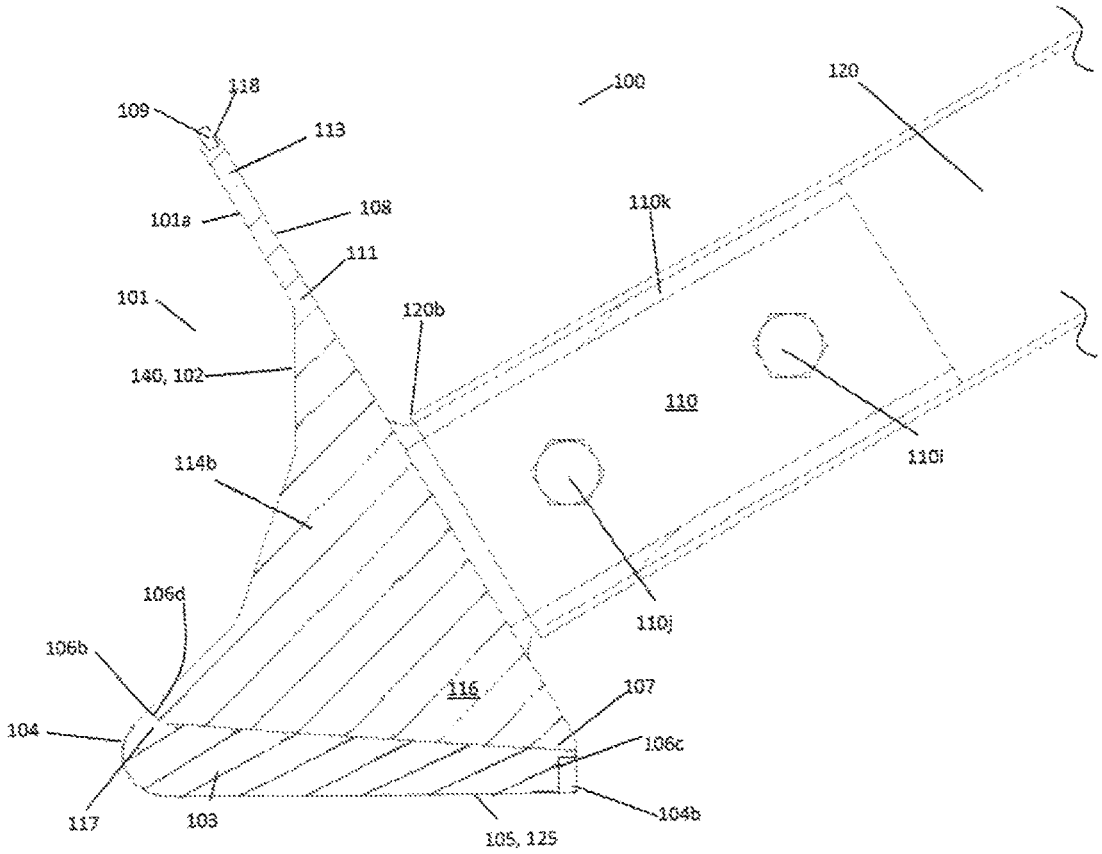

FIG. 2 illustrates an elevated side, cross sectional and partial view of one embodiment of the present invention, for Cross Section 2-2, depicting the longitudinally extending screed head without a hollow interior. The rake handle is partially shown. Cross Section 2-2 is located on FIG. 4. and is the same sectional (perpendicular) orientation as that of Cross Section 1-1.

Figure 3:
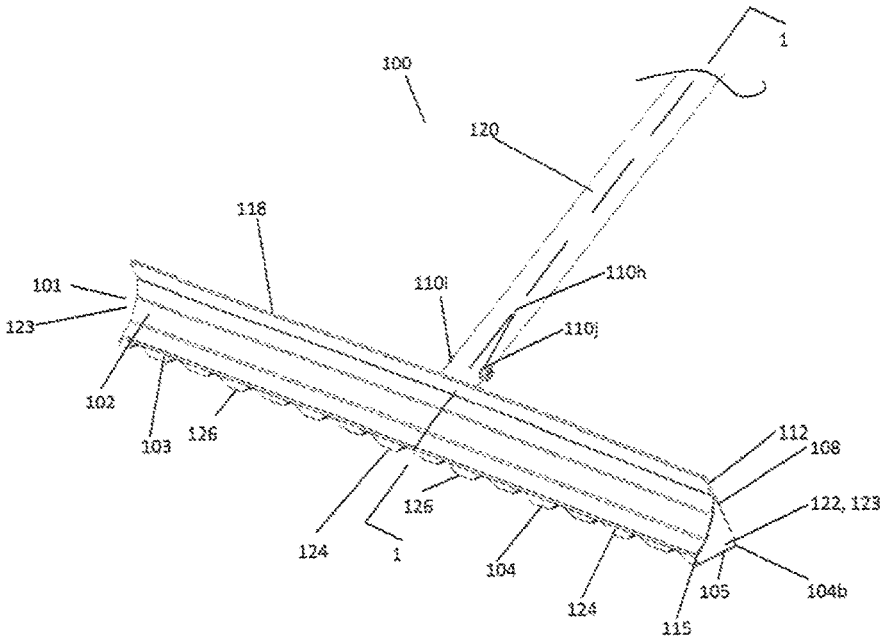

FIG. 3 illustrates a partial perspective view of one embodiment of the present invention, depicting the longitudinally extending screed head and a partial view of the rake handle. The location of Cross Section 1-1 is depicted in FIG. 3.

Figure 4:
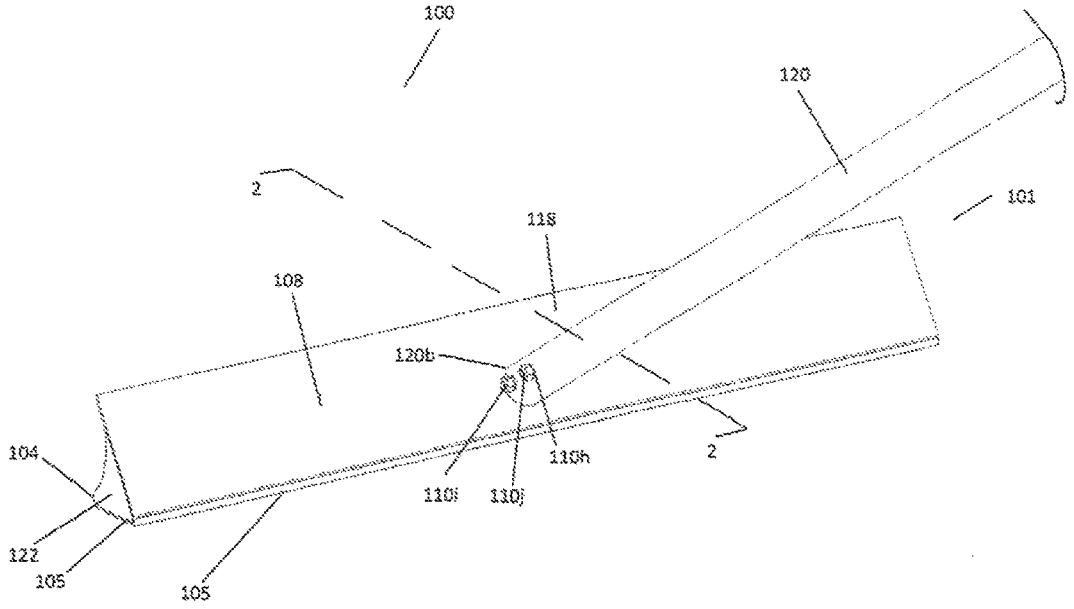

FIG. 4 illustrates a partial back perspective view of one embodiment of the present invention, depicting the longitudinally extending screed head and a partial view of the rake handle. The location of Cross Section 2-2 is depicted in FIG. 4.

Figure 5:
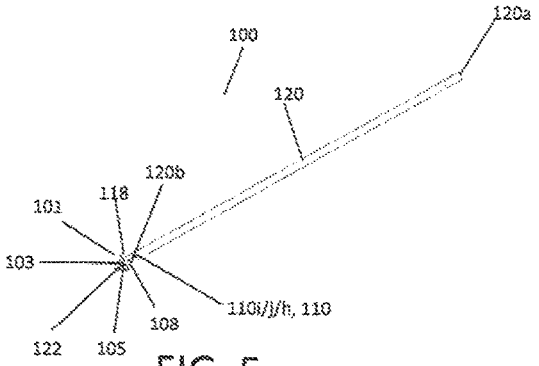

FIG. 5 illustrates a side elevational view of one embodiment of the present invention, having an underside shoe.

Figure 6:
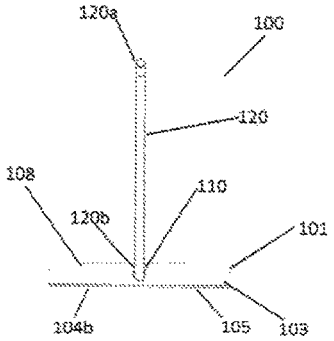

FIG. 6 illustrates a back elevational view of one embodiment of the present invention, having an underside shoe and depicting the rake handle attached to the longitudinally extending screed head element.

Figure 7:
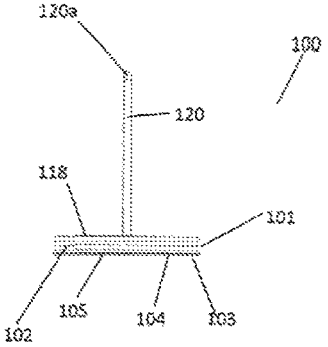

FIG. 7 illustrates a front perspective view of one embodiment of the present invention, having an underside shoe.

Figure 8:
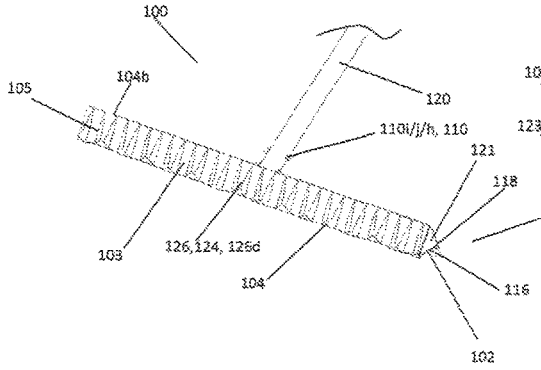

FIG. 8 illustrates a partial, back and underside perspective view of one embodiment of the present invention, depicting the underside shoe having a textured bottom surface, as a repetitive form, dampening and flattening in amplitude toward the shoe back end. The depiction of the repetitive triangular shapes on the shoe underside in FIG. 8 and the same depictions of the repetitive form in other accompanying figures are shown to depict a repetitive form for particular textured bottom surfaces. The rake handle is partially shown.

Figure 9A:
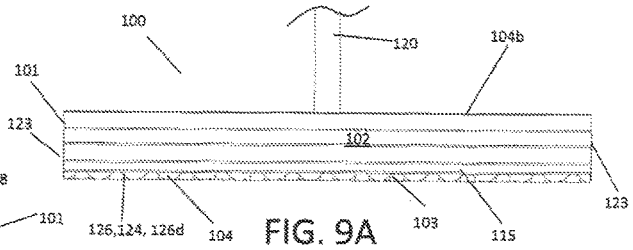
Figure 15A:
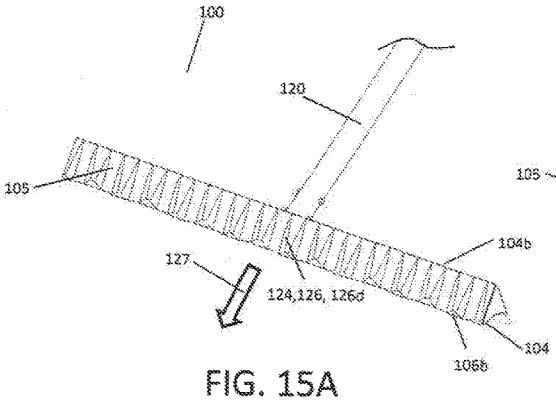

As shown in FIG. 8, and FIGS. 9A and 15A below, the tapered triangular shapes, tapered toward the shoe back end depict the dampening or flattening of the particular textured bottom surface, such as the wave form bottom surface in FIG. 8.

FIGS. 9A-D illustrate partial, front elevational views of alternative embodiments of the present invention, depicting, among other elements, the underside shoe, as follows:

FIG. 9A illustrates the underside shoe having a textured bottom surface, as a wave form bottom surface, in a repetitive form, dampening toward the shoe back end. The rake handle is partially shown.

Figure 9B:
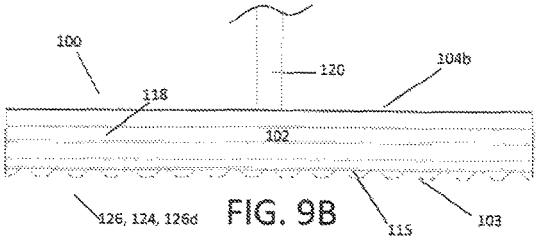

FIG. 9B illustrates the underside shoe having a textured bottom surface, as a wave form bottom surface, in a repetitive form, without dampening. The rake handle is partially shown.

Figure 9C:
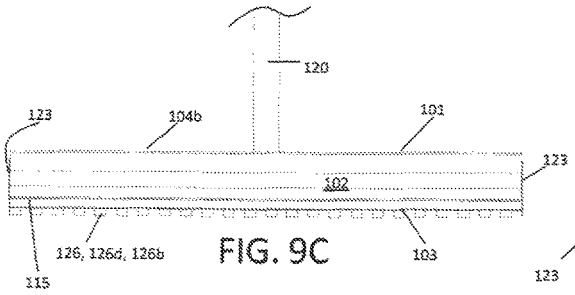

FIG. 9C illustrates the underside shoe having a textured bottom surface, as a block shaped bottom surface without dampening. The rake handle is partially shown.

Figure 9D:
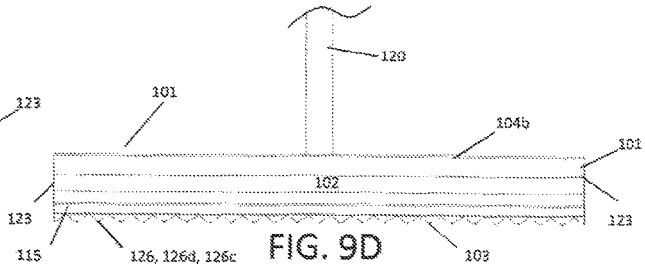

FIG. 9D illustrates the underside shoe having a textured bottom surface, as a v-shaped bottom surface without dampening. The rake handle is partially shown.

Figure 10:
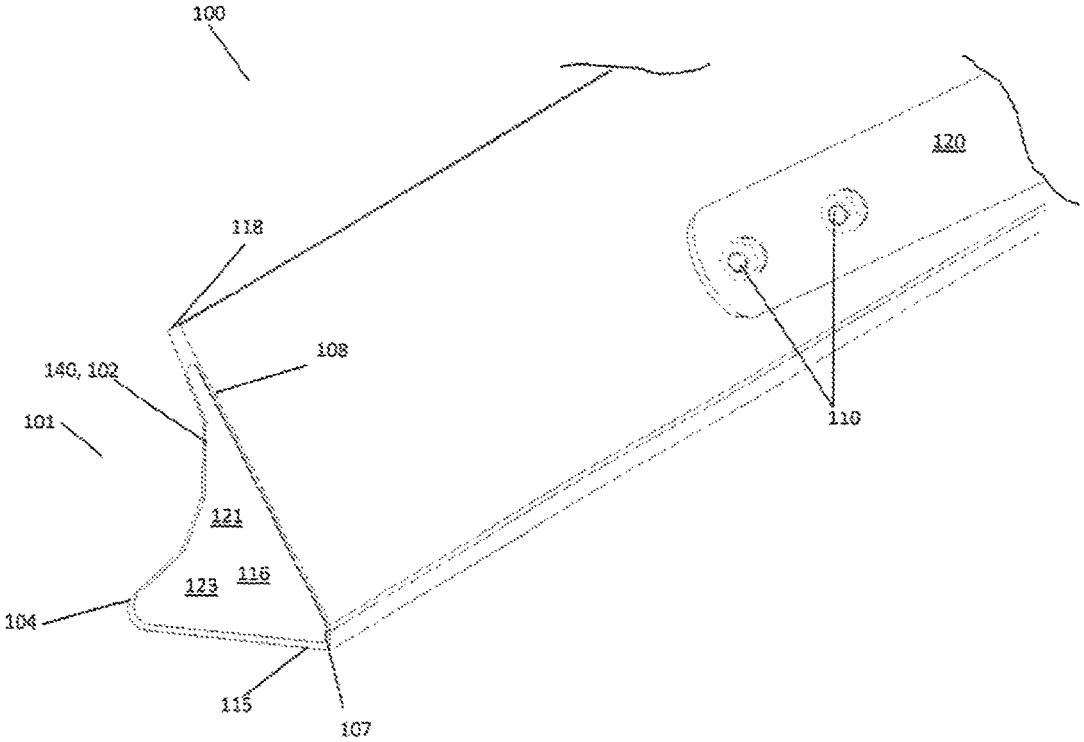

FIG. 10 illustrates a partial back perspective view of one embodiment of the present invention, partially depicting the longitudinally extending screed head without an underside shoe and one of a pair of opposing screed end caps. The rake handle is partially shown.

Figure 11:
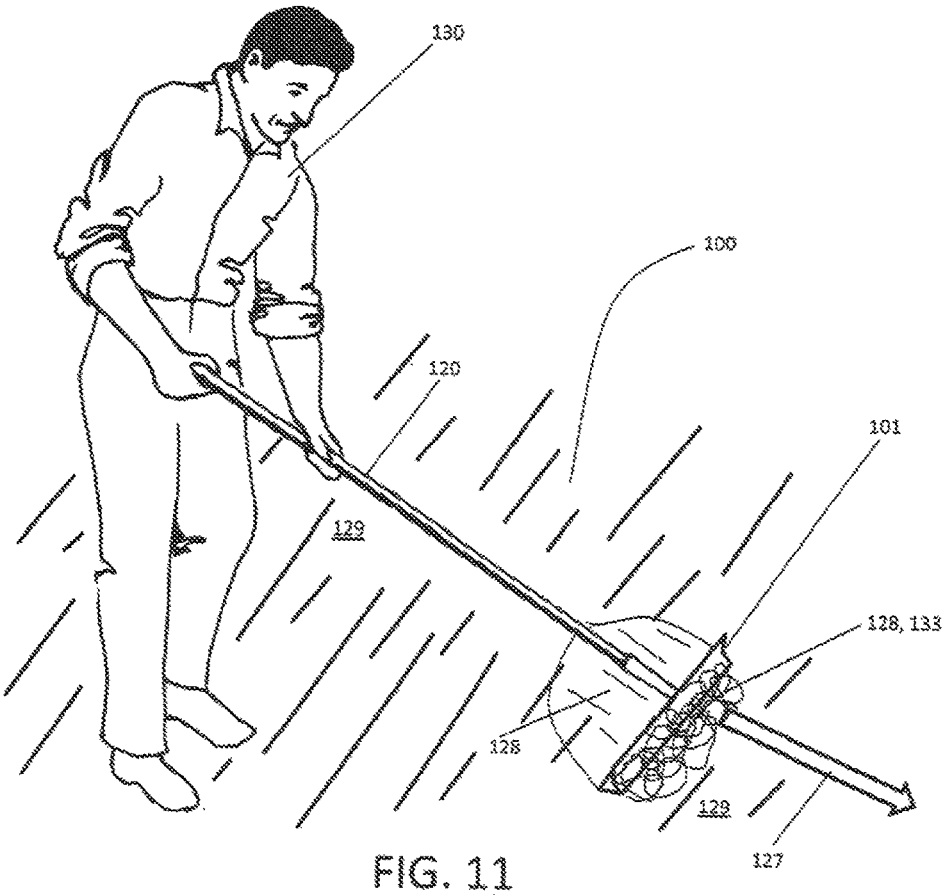

FIG. 11 illustrates a perspective view of one embodiment of the present invention, depicting a user moving the hand held screed raking device by the tubular rake handle and dozing application material over a surface.

Figure 12:
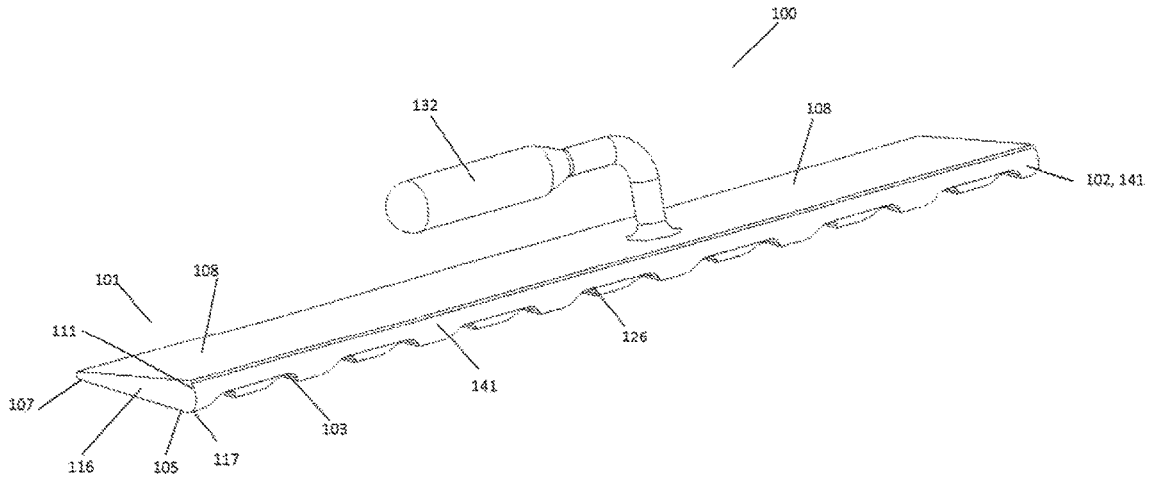

FIG. 12 illustrates a perspective view of an alternative embodiment of the present invention, depicting a rake grip handle attaching to the longitudinally extending screed head, and a textured bottom surface.

Figure 13:
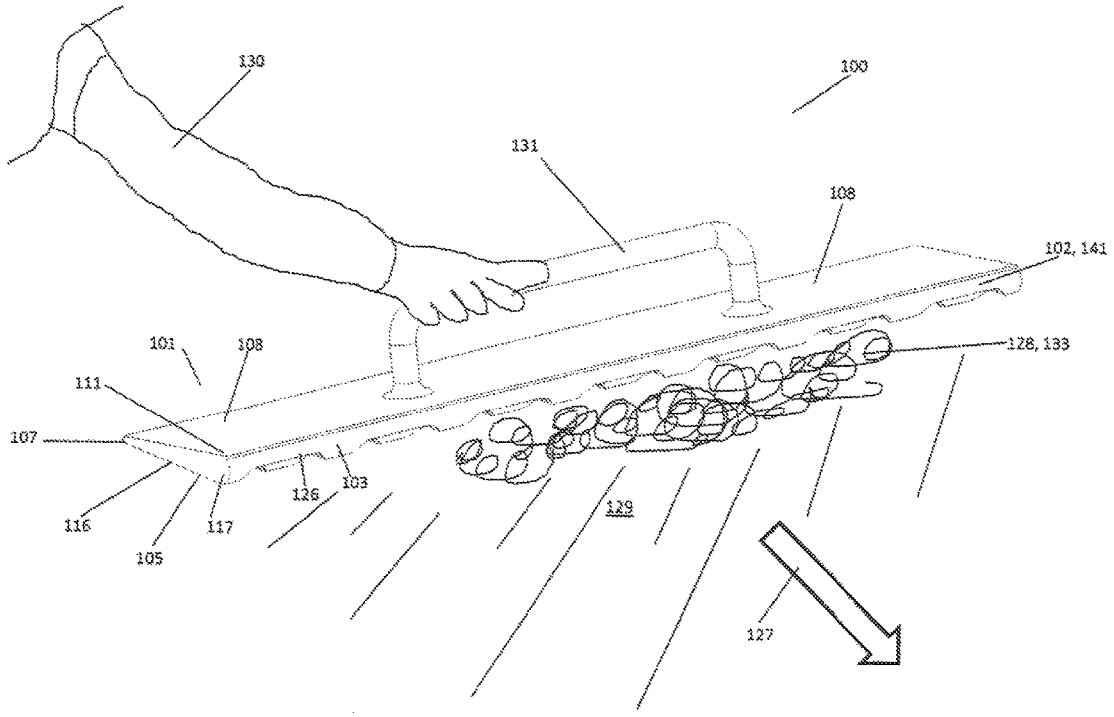

FIG. 13 illustrates a perspective view of an alternative embodiment of the present invention, depicting a rake opened grip handle attaching to the longitudinally extending screed head, having a textured bottom surface, and a user moving the hand held screed raking device and dozing application material over a surface.

Figure 14:
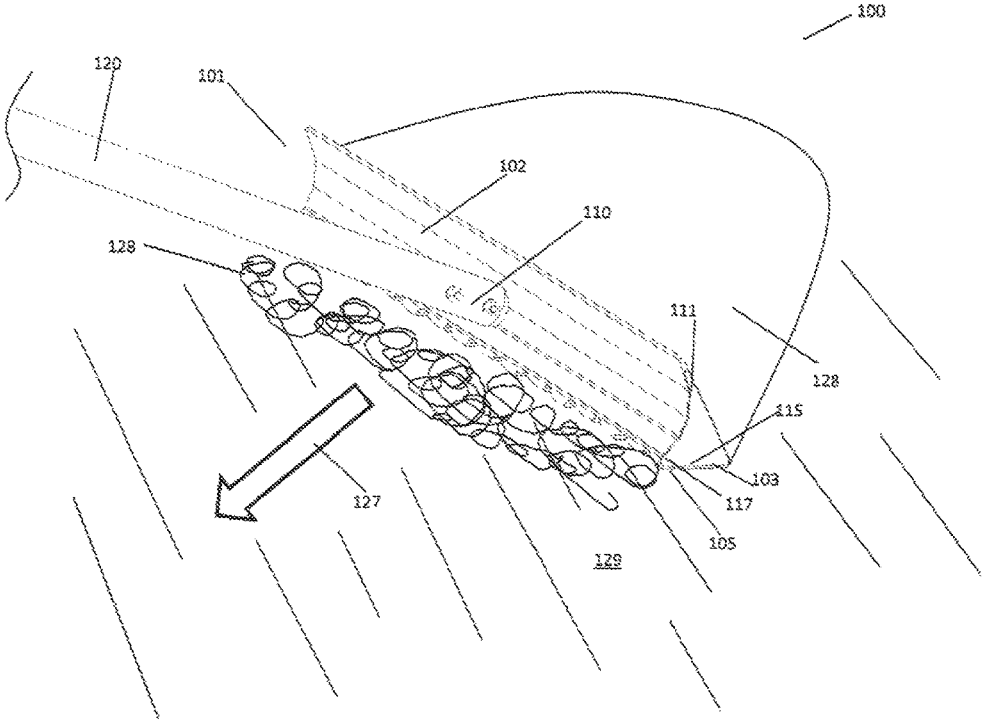

FIG. 14 illustrates a perspective view of one embodiment of the present invention, depicting the hand held screed raking device being pulled over a surface, instead of pushed, while dozing application material, the rake handle (partially viewed) attaching to the arced dozer front face.

FIGS. 15A-D illustrate partial, back and underside perspective views of embodiments of the present invention, as follows:

FIG. 15A depicts the underside shoe having a textured bottom surface as a wave form bottom surface, having a repetitive form, the textured bottom surface flattening and dampening in amplitude from the opposing shoe toe securing end to the shoe back end. The rake handle is partially shown, and the textured bottom surface is oriented parallel to the applying direction of the user.

Figure 15B:
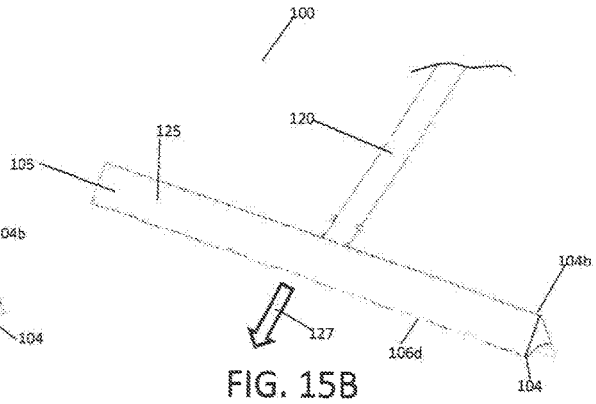

FIG. 15B depicts the underside shoe having a smooth bottom surface. The rake handle is partially shown.

Figure 15C:
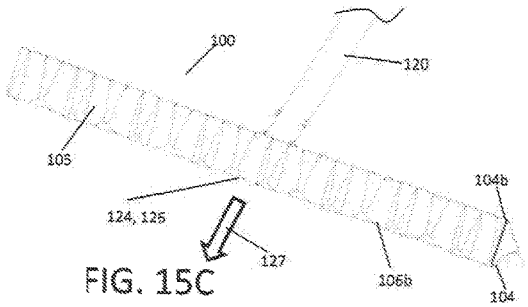

FIG. 15C depicts the underside shoe having a textured bottom surface, as a wave form bottom surface, having a variable form, the textured bottom surface flattening and dampening in amplitude from the opposing shoe toe securing end to the shoe back end, in the manner as was described by FIG. 8 above. The depiction of the varying triangular shapes on the shoe underside in FIG. 15C is shown to depict the variable wave form for the particular textured bottom surface. The rake handle is partially shown, and the textured bottom surface is oriented parallel to the applying direction of the user.

Figure 15D:
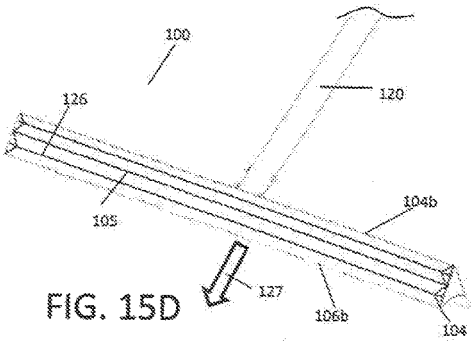

FIG. 15D depicts the underside shoe having a textured bottom surface, having a repetitive form, the textured bottom surface oriented perpendicular to the to the applying direction of the user, and longitudinally lengthwise with the longitudinally extending screed head. The rake handle is partially shown.

DETAILED DESCRIPTION OF THE INVENTION

The present invention will now be described more fully hereinafter with references to the accompanying drawings, in which the preferred embodiment of the invention is shown. This invention, however, may be embodied in different forms, and should not be construed as limited to the embodiments set forth herein. Rather, the illustrative embodiments are provided so that this disclosure will be thorough and complete, and will fully convey the scope of the invention to those skilled in the art. It should be noted, and will be appreciated, that numerous variations may be made within the scope of this invention without departing from the principle of this invention and without sacrificing its chief advantages. Like numbers refer to like elements throughout. A representative number of certain repeated elements are labeled in the drawings.

Turning now in detail to the drawings in accordance with the present invention, as shown in FIGS. 1-11, in one embodiment of the present invention, a hand held screed raking device 100 comprises a longitudinally extending screed head 101. As shown in cross sectional FIGS. 1 (1-1 as located on FIG. 3) and 2 (2-2 as located on FIG. 4), the longitudinally extending screen includes an upper head portion 101*a*, an arced dozer front face 102, a screed back 108, an angularly attached bottom plate 115, and a pair of opposing screed head ends 123 (see FIGS. 3 and 9). The arced dozer front face 102 may be, in alternative embodiments, a concavely arced face 140 (FIGS. 1, 2 and 10) or a convexly arced face 141 (FIGS. 12 and 13, alternative embodiments of the present invention). The arced dozer front face 102 acutely and downwardly connects to the angular bottom plate 115 at an arc/bottom contact point 117, terminating at a screed head cooperating toe securing end 106*d*, and oppositely and upwardly connects to the screed back 108 at an arc/back contact point 111. The upper head portion 101*a* is located above, and attaches to, the arced dozer front face 102 and the screed back 108 at the arc/back contact point 111. The angular bottom plate 115 acutely connects oppositely from the arc/back contact point 111 to the screed back 108 at a back/bottom contact point 107, and in that manner, thereby the arced dozer front face 102, the screed back 108, and the angular bottom plate 115 form a generally triangular cross sectional shape 116 to the longitudinally extending screed head 101. The longitudinally extending screed head 101 may further be comprised of aluminum, plastic, or other durable and lightweight material.

Figure 1:
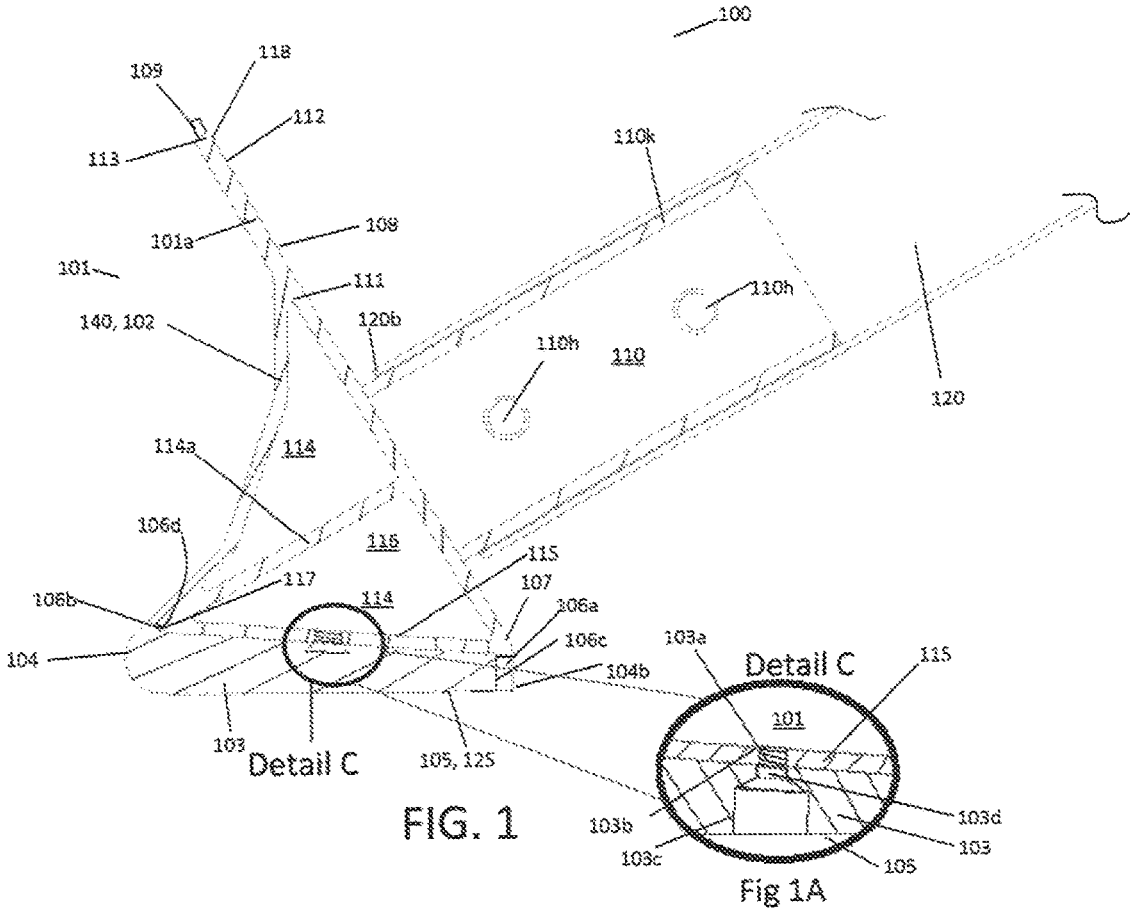
FIG. 1 illustrates an elevated side, cross sectional and partial view of one embodiment of the present invention, for Cross Section 1-1, depicting the longitudinally extending screed head having a hollow interior and a underside shoe. The rake handle is partially shown. Cross Section 1-1 is located on FIG. 3. As well, FIG. 1 provides the location for Detail C, depicted in the following cutaway view of FIG. 1A.

As shown in FIGS. 1 and 2, in alternative embodiments of the present invention, an underside shoe 103 conformably and cooperatively secures against the angular bottom plate 115 of the longitudinally extending screed head 101. The underside shoe 103 comprises an upwardly angled leading surface 104, a shoe back end 104*b* and an opposing shoe toe securing end 106*b*. The underside shoe 103 connects with, and abuts against, the arced dozer front face 102 with the opposing shoe toe securing end 106*b* against the screed head cooperating toe securing end 106*d*, and arcs downward and rearward, connecting to a longitudinal bottom trailing surface 105. The longitudinal bottom trailing surface 105 continues rearward laterally and terminates at the shoe back end 104*b*. In the present invention, the longitudinal bottom trailing surface 105 is defined as the entire bottom working surface of the underside shoe 103, as shown in FIGS. 1 and 2.

As shown particularly in FIGS. 1, 2 and 11, as well as FIGS. 3-8, in embodiments of the present invention, the handle held screed device 100 further comprises a tubular rake handle 120. The tubular rake handle 120 has a rake handle free end 120*a* and an opposing rake handle attaching end 120*b* attaching to the longitudinally extending screed head 101. The longitudinally extending screed head 101 further comprises a rake handle attaching means 110 locating centrally on the screed back 108 midway between the arc/back contact point 111 and the back/bottom contact point 107 and freely securing the tubular rake handle 120. The tubular rake handle 120 freely and securely attaches to and engages the longitudinally extending screed head 101 by the rake handle attaching means 110 which is proximal to the opposing rake handle attaching end 120*b*.

The upper head portion 101*a* depicted in FIGS. 1 and 2 of an embodiment of the present invention further comprises an upper back panhandle 112, adjoining the screed back 108 and the arced dozer front face 102 at the arc/back contact point 111. The upper head portion 101*a* terminates at an opposing panhandle end 118. In an alternative embodiment, an upper back slot 113 is located at the opposing panhandle end 118 and securely accommodates a removably protruding wear protective surface strip 109. The removably protruding wear protective surface strip 109 may be made of one of plastic, metal carbide, magnesium, titanium, or other lightweight and wear resistant material.

The rake handle attaching means 110, depicted in FIGS. 1-8, in embodiments of the present invention, comprises a tubular attaching arm 110*k* extending perpendicularly away from the screed back 108. The tubular rake handle 120 sliding snugly and freely fits over the tubular attaching arm 110*k* and against the screed back 108 at the opposing rake handle attaching end 120*b*, as first described above. At least one handle securing hole 110*h* operatively projects simultaneously through the tubular rake handle 120 and the tubular attaching arm 110*k*. The at least one handle securing hole 110*h* allows an at least one handle securing bolt 110*i* to secure the tubular rake handle 120 to the tubular attaching arm 110*k* with at least one handle securing nut 110*j*. As shown in FIGS. 1 and 2, the rake handle attaching means 110 may be viewed as a simple piece of "inner pipe" that welds to and/or is integrally part of, the screed back 108. The rake handle 120 simply slips over the rake handle attaching means 110, or the inner pipe, and has two cross bolts (the at least one handle securing bolt 110 and the at least one handle securing nut 110*j*) to hold the tubular rake handle 120 in place. In this embodiment, the hand held screed raking device 100 of FIGS. 1-11 is a hand held utility tool with a unique screed bottom and pre-strike design.

In alternative embodiments, the rake handle attaching means 110, depicted in FIGS. 1 and 2, may be a cotter pin, clip, weld or other temporary or permanent attaching means; and the tubular rake handle 120 may comprise non-conductive, lightweight, and resilient material.

The underside shoe 103, shown in FIG. 1 of one embodiment of the present invention, freely, securely and removably attaches against the angular bottom plate 115 by an at least one shoe attaching means 103*a*, as described below. The at least one shoe attaching means 103*a* allows the underside shoe 103 to be removable. In another alternative embodiment, a screed head cooperating heel securing notch 106*c* may be located immediately and vertically above the shoe back end 104*b*. The screed head cooperating heel securing notch 106*c* removably and securely houses a removable shoe heel wear protective surface strip 106*a*. The shoe heel wear protective surface strip 106*a* in alternative embodiments may be made of plastic, metal carbide, magnesium, titanium, or other lightweight and wear resistant material.

The longitudinal bottom trailing surface 105, shown in FIGS. 1-15 of alternative embodiments of the present invention, or the working surface referenced above, comprises one of a smooth bottom surface 125 (see FIGS. 2 and 15B)

or a textured bottom surface 126 (see FIGS. 8, 9A-D, 13, and 15A, 15C and 15D). The longitudinally extending screed head 101 further comprises, as depicted in the embodiment in FIG. 1, an interior flange support 121 located centrally within a hollow interior 114 attached from the arc/bottom contact point 117 midway along the screed back 108.

The textured bottom surface 126, as depicted in FIGS. 8, 9A-D, 13, and 15A, 15C and 15D, comprises at least one of: a repetitive form 126*d*, the form of the textured bottom surface 126 repeating on the longitudinal bottom surface 105 (see FIGS. 8 and 9A-D); a variable form 126*e*, the textured bottom surface 126 having differing forms and amplitudes (see FIG. 15C), such that the textured bottom surface 126 may be any one of a wave form bottom surface 124 (shown in FIGS. 3 and 8); a v-shaped bottom surface (shown in FIG. 9D); a block shaped bottom surface 126*b* (shown in FIG. 9C); or other form of textured bottom surface 126; or combination of those forms. The textured bottom surface 126 flattens and dampens in amplitude or wave height from the opposing shoe toe securing end 106*b* to the shoe back end 104*b*, and is oriented (its shape runs) in the applying direction 127 conducted by a user 130, or rake operator, as shown in FIGS., 8, 9A, 11 and 13. In alternative embodiments, shown in FIGS. 15A, C and D, the textured bottom surface 126 may be oriented with respect to the applying direction 127 of the user 130 as to its primary wave or form orientation in one of parallel, perpendicular, or at an acute angle direction (such as depicted in FIGS. 15 A, C and D).

In an alternative embodiment of the present invention, as shown in FIG. 10, a pair of opposing end caps 122 securely attach to the pair of opposing screed head ends 123. The pair of opposing end caps 122 may be temporarily or permanently welded or otherwise secured on each of the pair of opposing screed head ends 123 and thereby provide a sealed rake head as the longitudinally extending screed head 101.

In an alternative embodiment of the present invention, the at least one shoe attaching means 103*a*, as shown in FIGS. 1 and 1A (Detail C), comprises an at least one attaching bolt 103*d* threading upwardly through an at least one shoe hole 103*c* located in the longitudinal bottom trailing surface 105 and into an at least one threaded tapped bottom hole 103*b* which is located in the angular bottom plate 115 and cooperatively corresponds with the at least one shoe hole 103*c*. In this manner, thereby, the at least one shoe attaching means 103*a* secures and attaches the underside shoe 103 to the longitudinally extending screed head 101. The at least one shoe attaching means 103*a* may in alternative embodiments comprise clips, cotter pins or other attaching means.

As shown in FIGS. 11 and 13, in embodiments of the present invention, the user 130 is spreading, screeding, moving or applying (generally termed, "moving" or "applying" herein) and dozing the application material 128 by grasping and using the hand held screed raking device 100 by the tubular rake handle 120 and pushing or pulling (moving) the hand held screed device 100 over a surface 129. In FIG. 11, the user 130 is pushing the hand held screed raking device 100 using the tubular rake handle 120. The application material 128 gathers and loads along the arced dozer front face 102. The arced dozer front face 102 keeps the longitudinally extending screed head 101 from lifting upward as the hand held screed raking device 100 simultaneously and homogeneously applies, screeds, and compacts the application material 128 onto the surface 129 in an applying direction 127 as traversed by the user 130. The application material 128 is the material being applied to the surface 129 and may be selected from a group consisting of: glue laminates, asphalt, cement, tile and floor grout, mortar, landscaping topsoil, gravel, aggregate, mulch, dirt, or other surface treatment material 133.

As shown in FIG. 14, in an alternative embodiment of the present invention, the hand held screed raking device 100, the longitudinally extending screed head 101 comprises an upper head portion 101*a*, an arced dozer front face 102, a screed back 108, an angularly attached bottom plate 115, and a pair of opposing screed head ends 123 (all of which elements are as shown in FIGS. 1 and 2). The arced dozer front face 102 has either a concavely arced face 140 or a convexly arced face 141 (see also FIG. 12). The arced dozer front face 102 connects acutely and downwardly to the angular bottom plate 115 at an arc/bottom contact point 117, terminating at a screed head cooperating toe securing end 106*d*, and oppositely and acutely, upwardly connecting to the screed back 108 at the arc/back contact point 117 (all of which elements are as shown in FIGS. 1 and 2). The upper head portion 101*a* is located above and attaches to the arced dozer front face 102 and the screed back 108 at an arc/back contact point 111. The angular bottom plate 115 connects acutely and oppositely from the arc/back contact point 111 to the screed back 108 at a back/bottom contact point 107. In this manner, the arced dozer front face 102, the screed back 108, and the angular bottom plate 115 form a generally triangular cross sectional shape 116 to the longitudinally extending screed head 101. The hand held screed raking device 100 in this alternative embodiment (as shown as well in detail in FIG. 1) also has an underside shoe 103 is comprised of an upwardly angled leading surface 104, a shoe back end 104*b* and an opposing shoe toe securing end 106*b*. The underside shoe 103 connects with and abuts against the arced dozer front face 102 at the screed head cooperating toe securing end 106*d* with the opposing shoe toe securing end 106*b* securing, conformably and cooperatively securing against the angular bottom plate 115, and arcing downward and rearward, connecting to a longitudinal bottom trailing surface 105. The longitudinal bottom trailing surface 105 continues rearward laterally and terminating at the shoe back end 104*b*. A tubular rake handle 120 has a rake handle free end 120*a* and an opposing rake handle attaching end 120*b* (as shown in detail in FIGS. 5-7).

Again, as shown on FIGS. 1 and 2, as well as 14, the longitudinally extending screed head 101 in this alternative embodiment has a rake handle attaching means 110 located centrally on the arced dozer front face 102 midway between the arc/back contact point 111 and the arc/bottom contact point 117, freely securing the tubular rake handle 120. The tubular rake handle 120 freely and securely attaches to and engages the longitudinally extending screed head 101 by the rake handle attaching means 110 proximal to the opposing rake handle attaching end 120*b*.

In this alternative embodiment of the present invention, shown in FIG. 14, the user 130 (as similarly shown in FIG. 11) grasps the tubular rake handle 120 and spreads, screeds, moves or applies and dozes the application material 128, by grasping the hand held screed raking device 100 by the tubular rake handle 120 and pulling (moving) the hand held screed raking device 100 over a surface 129 in the applying direction 127. The application material 128 gathers and loads along the arced dozer front face 103, and the arced dozer front face 103 prevents the longitudinally extending screed head 101 from lifting upward as the hand held screed raking device 100 simultaneously and homogeneously applies, screeds, and compacts the application material 128 onto the surface 129 in a non-segregating manner and in an applying direction 127 as traversed by the user 130 over the surface 129.

The rake handle attaching means 110, in the alternative embodiment shown in FIG. 14, comprises a tubular attaching arm 110*k* (as shown in FIG. 1) extending in this embodiment perpendicularly away from the arced dozer front face 102, as shown in FIG. 14. The tubular rake handle 120 slides snugly and freely over the tubular attaching arm 110*k* and attaches securely against the arced dozer front face 102 at the opposing rake handle attaching end 120*b* (in the manner as shown in FIG. 1). At least one handle securing hole 110*h* operatively projects simultaneously through the tubular rake handle 120 and the tubular attaching arm 110*k*, allowing at least one handle securing bolt 110*i* to secure the tubular rake handle 120 to the tubular attaching arm 110*k* with the at least one handle securing nut 110*j*.

As more particularly depicted in FIGS. 1 and 1A in an alternative embodiment of the present invention, the hand held screed raking device 100 depicted in FIG. 14 has the underside shoe 103 freely, securely, and removably attaching against the angular bottom plate 116 of the longitudinally extending screed head 101 by an at least one shoe attaching means 103*a* having an at least one attaching bolt 103*d* threading upwardly through an at least one shoe hole 103*c* located in the longitudinal bottom trailing surface 105 and into an at least one threaded tapped bottom hole 103*b* located in the angular bottom plate 115 and cooperatively corresponding with the at least one shoe hole 103*c*. The underside shoe 103 is secured and attached, in this manner, to the longitudinally extending screed head 101.

As noted above, FIGS. 15A-D illustrate partial, back and underside perspective views of embodiments of the present invention, having a tubular rake handle 120. The longitudinal bottom trailing surface 105 can be either a smooth bottom surface 125 or a textured bottom surface 126. The textured bottom surface 126 of the underside shoe 103 comprises, in alternative embodiments as shown in FIGS. 15A, 15C and 15D, a wave form bottom surface 124 (shown in FIGS. 3 and 8); a v-shaped bottom surface (shown in FIG. 9D); a block shaped bottom surface 126*b* (shown in FIG. 9C); or other form of textured bottom surface 126, which forms may be in a repetitive form 126*d* or a variable form 126*e*. The textured bottom surface 126 may, in an alternative embodiment, flatten and dampen in amplitude from the opposing shoe toe securing end 106*b* to the shoe back end 104*b*, as depicted in FIGS. 8 and 15A. At the same time, the textured bottom surface 126 in alternative embodiments, may be oriented in parallel, as shown in FIGS. 8 and 15A, perpendicular as shown in FIG. 15D, or at an acute angle to the applying direction 127 of the user 130 of the hand held screed raking device 100. FIG. 15A depicts the underside shoe 103 having a textured bottom surface 126, as a repetitive form 124*d*, the textured bottom surface 126 flattening and dampening in amplitude from the opposing shoe toe securing end 106*b* to the shoe back end 104*b*. FIG. 15B depicts the underside shoe 103 having a smooth bottom surface 125. FIG. 15C depicts the underside shoe 103 having a textured bottom surface 126, as a variable form 124*e*, the wave form bottom surface 124 having varying amplitudes (as indicated by the description of FIG. 8 above), and the textured bottom surface 126 flattening and dampening in amplitude from the opposing shoe toe securing end 106*b* to the shoe back end 104*b*. FIG. 15D depicts the underside shoe 103 having a textured bottom surface 126, as a repetitive form 124*d*, and the textured bottom surface 126 oriented longitudinally lengthwise, parallel with the longitudinally extending screed head 101, and perpendicular to the applying direction 127.

The textured bottom surface 126, shown in FIGS. 3, 8, 12, 13, and 15A, C and D, enables larger aggregates of application material 128 to be moved or travel more easily underneath the hand held screed raking device 100 and intermix in a homogeneous manner to discourage any segregation of particle size of the application material 128 on the surface 129.

In alternative embodiments of the present invention, the tubular rake handle shown in FIGS. 1-11 and 14 may comprise non-conductive, lightweight, and resilient material. The tubular rake handle 120, as well as a rake grip handle 131, described below in an alternative embodiment, are formed from material which is less thermally conductive or non-conductive than in prior art. The rake grip handle 131 includes any number of handle grips attached at two points in the screed back 108 common in the industry for use with trowel-like tools.

In an alternative embodiments of the present invention, shown in FIGS. 12 and 13, the hand held screed raking device 100 comprises a longitudinally extending screed head 101 having a convexly arced dozer front face 141, a screed back 108, and a longitudinal bottom trailing surface 105. The convexly arced dozer front face 141 acutely connects to and terminates downwardly at the longitudinal bottom trailing surface 105 at an arc/bottom contact point 117 and oppositely and acutely upwardly connects to the screed back 108 at an arc/back contact point 111. The longitudinal bottom trailing surface 105 oppositely and acutely connects to the screed back 108 at a back/bottom contact point 107. In this configuration thereby, the convexly arced dozer front face 141, the screed back 108, and the longitudinal bottom trailing surface 105 form a generally triangular cross sectional shape 116 to the longitudinally extending screed head 101; and the convexly arced dozer front face 141 arcs downward to the arc/bottom contact point 117. In this alternative embodiment, the rake grip handle 131 (in FIG. 12) securely attaches to the longitudinally extending screed head 101 midway vertically down and centrally on the screed back 108 between the back/bottom point 107 and the arc/back contact point 111. The user 130 grasps the hand held screed raking device 100 by the rake grip handle 131 to hand doze application material 128 which gathers and loads along the arced dozer front face 102, and the hand held screed raking device 100 simultaneously and homogeneously applying, screeding, and compacting the application material 128 onto a surface 129 in a non-segregating manner and in an applying direction 127 as traversed by the user 130. In this manner, the hand held screed raking device 100 discourages or minimizes the application material 128 from being applied to the surface 129 in a segregated manner as to particle size or other component, which would affect the integrity of the application material 128. The rake grip handle 131 shown in FIG. 12 is a closed grip handle. FIG. 13 in an alternative embodiment shows the hand held screed raking device 100 with the rake grip handle 131 may be an opened grip rake handle 132.

In the alternative embodiments of the present invention shown in FIGS. 12 and 13, the longitudinal bottom trailing surface 105 (in the same manner as depicted in FIGS. 8, 9 A-D and 15 A-D for other embodiments) may have a smooth bottom surface 125 or a textured bottom surface 126. The textured bottom surface 126 may be any one of a wave form bottom surface 124, a v-shaped bottom surface 126*c*, a block shaped bottom surface 126*b*, or other form of textured bottom surface 126. As well, the textured bottom surface 126 is one of a repetitive form 126*d* or a variable form 126*e* as shown in FIGS. 15A and B, and discussed above for another embodiment. The textured bottom surface 126 may be oriented to the applying direction as one of: parallel, perpendicular, or at an acute angle. FIG. 15D depicts the underside shoe 103 having a textured bottom surface 126, as a repetitive form 124*d*, the textured bottom surface oriented longitudinally lengthwise, parallel with the longitudinally extending screed head 101, and perpendicular to the applying direction 127. The textured bottom surface 126 in alternative embodiments flattens and dampens in amplitude from the arc/bottom contact point 117 to the back/bottom contact point 107.

The longitudinally extending screed head 101, shown in FIGS. 12 and 13, may be comprised in alternative embodiments of at least one of aluminum, plastic, or other durable and lightweight material. The rake grip handle 131, in alternative embodiments, as shown in FIGS. 12 and 13, may be made of light and rigid material with low thermal conductivity to help the user 130 work with different types and temperatures of application material 128, helping to keep the user's 130 hands from getting either hot or cold.

The application material 128 depicted in FIGS. 13 and 14 in alternative embodiments may be selected from a group consisting of glue laminates, asphalt, cement, tile and floor grout, mortar, landscaping topsoil, gravel, aggregate, mulch, dirt, or other surface treatment material 133 as applied to the surface 129 by the user 130. The rake grip handle 131 be comprised in alternative embodiments of a non-conductive, lightweight, and resilient material.

As shown in the alternative embodiments in FIGS. 1, 2, and 11-14, the hand held screed raking device 100 of the present invention is a hand held tool for spreading, screeding, moving or applying application material 128, as described above, including viscous material such as asphalt, concrete, grout, glue, or landscape materials such as dirt. The hand held screed raking device 100 will utilize either the smooth bottom surface 125, the group of textured bottom surface 126 forms as described herein or other textured bottom surface forms, such as patented screed textured surfaces known in the industry, to help discourage application material 128 segregation when the user 130 moves and applies the application material 128 to the surface 129. The longitudinal bottom trailing surface 105, the working underside surface, therefore, may be the smooth bottom surface 125 or, in an alternative embodiments, the textured bottom surface 126, such as one with a repetitive form 124*d* (shown in FIGS. 3 and 8, and 15A), identified by a cross-sectional shape resembling a repeating pattern of cresting waves, the amplitude or height of which gradually decrease in size from the upwardly angled leading surface 104 to the shoe back end 104*b*, as shown in FIGS. 15A and 15C.

The longitudinal bottom trailing surface comprising one of a smooth bottom surface or a textured bottom surface, as shown in alternative embodiments in FIGS. 1-15. The present invention, the hand held screed raking device 100, is operated similar to any hand held rake or trowel with the added control in the present invention of pitching the screed surface angle of attack, defined by the upwardly angled leading surface 104, to control application material 128 grade during use in the applying direction 127. The arced dozer front face 102 may have the concavely arced dozer face 140 (as shown in FIGS. 1 and 2) or the convexly arced dozer 141 in alternative embodiments. The arced dozer front face 102 more evenly distributes the application material 128 being laid or spread out by the user 130 in the applying direction 127 while leaving a better, less segregated application material 128 on the surface 129, by allowing the "floating screed", the application material 128, to be controlled by pitching the angle of attack of the longitudinal bottom trailing surface 105. The arced dozer front face 102 of the longitudinally extending screed head 101 keeps the loaded arced dozer front face 102 from lifting the hand held screed raking device 100 while it is moving and applying, or screeding, the application material 128 on the surface 129. By adjusting the vertical angle of attack, the user 130 can make smooth grade adjustments while spreading, in the applying direction 127, the application material 128 being raked or applied. As the application material 128 travels in the applying direction 127 under the longitudinal bottom trailing surface 105, it is compacted. These functions and actions of the hand held screed raking device 100 leave a better finish on the surface 129 for the application material 128 without the segregation of portions of the application material 128 caused by a traditional straight edged rake found in the industry.

The problem of segregation is solved by the present invention, as shown in FIGS. 11 and 13, by allowing the entire gradation of application material 128 to flow, or move and apply easier under the surface of the hand held screed raking device 100 (the longitudinally attached bottom trailing surface 101) by having a screed bottom (again, the longitudinally attached bottom trailing surface 101) with either the smooth bottom surface 125 or the textured bottom surface 126, having a repetitive form 124*d* or a variable form 124*e*, employed with the textured bottom surface 126. See FIGS. 15A-D. By using a unique variable wave design, such as a wave form bottom surface 124 having a variable form 126*e*, the application material 128, such as aggregate, may be evenly spread and compacted on the surface 129 in a homogenous fashion. The problem of patching an area of the surface 129 with desirous application material 128 but ultimately segregating it into various portions of non-desirous application material 128 having uneven grades and composition is solved, by applying the application material 128 in the applying direction 127 ahead of the hand held screed raking device 100 which greatly reduces the grade of the arced dozier front face 102, allowing for greater compaction of application material 128 and discouraging the segregation of application material 128, for example, into large and smaller aggregates fines.

The variable wave form 124*e*, shown in FIG. 15C in an alternative embodiment of the present invention, allows application material 128 of larger aggregates to travel or move easier under the longitudinally attached bottom trailing surface 105, further discouraging segregation by compacting the larger aggregate being laid into the surface 129, rather than, as occurs in traditional rakes used in the industry, such application material 128 moving or traveling in front of the hand held screed raking device 100 while the finer application material 128 is laid and thereby segregating the application material 128.

In alternative embodiments of the present invention shown in FIGS. 1-15, the longitudinally extending screed head 101 may be comprised of one or more of the following: aluminum, plastic, or other durable and lightweight material preventing hotter application material 128 from sticking to the hand held screed raking device 100 as easily as with commonly known screed raking devices, and preventing wetter application material 128 from freezing and sticking.

Another advantage found in alternative embodiments of the present invention, shown in FIGS. 1, 2, and 11-13, is that the hand held screed raking device 100 may be made of low thermal conductive materials that by not sticking as easily to the application material 128, application material 128 such as asphalt, the quality of the screed finish on the surface 129 will increase.

There is, as well, the advantage of an ease of use allowing different handle pitch options for taller users 130 with the hand held screed raking device 100. Use of the hand held screed raking device 100 is not limited to or specific to any one industry. The hand held screed raking device 100 may be used in the paving industry, concrete industry, construction industry, landscaping industry, as well as other industries where the use of such hand held equipment for applying application material 128 is required, allowing a user 130 to more easily obtain an acceptable grade of application material 128 without the segregation problems that are inherent to current rakes found in different industries. The present invention is useful in spreading a multitude of application materials 128, including, but not limited to, aggregates and aggregate mixtures, soils, landscaping materials; and in a number of applications, such as for distributing glue or grout, patching asphalt, for preparing subgrade surfaces, and for tiling or finishing surfaces, and other surface application activities.

Having thus described in detail a preferred selection of embodiments of the present invention, it is to be appreciated, and will be apparent to those skilled in the art, that many physical changes could be made in the device without altering the invention, or the concepts and principles embodied therein. Unless otherwise specifically stated, the terms and expressions have been used herein as terms of description and not terms of limitation, and are not intended to exclude any equivalents of features shown and described or portions thereof. Various changes can, of course, be made to the preferred embodiment without departing from the spirit and scope of the present invention. The present invention apparatus, therefore, should not be restricted, except in the following claims and their equivalents.

Although specific advantages have been enumerated above, various embodiments may include some, none, or all of the enumerated advantages.

Other technical advantages may become readily apparent to one of ordinary skill e art after review of the foregoing figures and description.

It should be understood at the outset that, although exemplary embodiments are illustrated in the figures and described herein, the principles of the present disclosure may be implemented using any number of techniques, whether currently known or not. The present disclosure should in no way be limited to the exemplary implementations and techniques illustrated in the drawings and described herein.

Unless otherwise specifically noted, articles depicted in the drawings are not necessarily drawn to scale.

Modifications, additions, or omissions may be made to the systems, devices, apparatuses, and methods described herein without departing from the scope of the disclosure. For example, the components of the systems, devices, and apparatuses may be integrated or separated. Moreover, the operations of the systems, devices and apparatuses disclosed herein may be performed by more, fewer, or other components, and the methods described may include more, fewer, or other steps. Additionally, steps may be performed in any suitable order. As used in this document, "each" refers to each member of a set or each member of a subset of a set.

To aid the Patent Office and any readers of any patent issued on this application in interpreting the claims appended hereto, applicants wish to note that they do not intend any of the appended claims or claim elements to invoke 35 U.S.C. 112(1) unless the words "means for" or "step for" are explicitly used in the particular claim.

This patent will not limit us to just the said verbiage but have the flexibility to be able to utilize this concept for many applications and many industries.

We claim:

1. A hand held screed raking device, said device comprising:

(a) a longitudinally extending screed head comprising:

(i) an upper head portion, an arced dozer front face, a screed back, an angularly attached bottom plate, and a pair of opposing screed head ends;

(ii) the arced dozer front face comprising one of: a concavely arced face or a convexly arced face;

(iii) the arced dozer front face acutely and downwardly connecting to the angular bottom plate at an arc/bottom contact point, terminating at a screed head cooperating toe securing end, and oppositely and acutely, upwardly connecting to the screed back at an arc/back contact point;

(iv) the upper head portion locating above and attaching to the arced dozer front face and the screed back at the arc/back contact point;

(v) the angular bottom plate acutely connecting oppositely from the arc/back contact point to the screed back at a back/bottom contact point, thereby the arced dozer front face, the screed back, and the angular bottom plate forming a generally triangular cross sectional shape to the longitudinally extending screed head;

(vi) an underside shoe comprising: an upwardly angled leading surface, a shoe back end and an opposing shoe toe securing end; and (vii) the underside shoe connecting with and abutting against the arced dozer front face at the screed head cooperating toe securing end with the opposing shoe toe securing end, conformably and cooperatively securing against the angular bottom plate, and arcing downward and rearward, connecting to a longitudinal bottom trailing surface, the longitudinal bottom trailing surface continuing rearward laterally and terminating at the shoe back end;

(b) a tubular rake handle comprising a rake handle free end and an opposing rake handle attaching end;

(c) the longitudinally extending screed head further comprising: a rake handle attaching means locating centrally on the screed back midway between the arc/back contact point and the back/bottom contact point and freely securing the tubular rake handle; and (d) the tubular rake handle freely and securely attaching to and engaging the longitudinally extending screed head by the rake handle attaching means proximal to the opposing rake handle attaching end.

2. The hand held screed raking device of claim 1, wherein the upper head portion further comprising:

(a) an upper back panhandle, adjoining the screed back and the arced dozer front face at the arc/back contact point and terminating at an opposing panhandle end;

(b) an upper back slot locating at the opposing panhandle end and securely accommodating a removably protruding wear protective surface strip; and (c) wherein the removably protruding wear protective surface strip is selected from a group consisting of plastic, metal carbide, magnesium, titanium, or other lightweight and wear resistant material.

3. The hand held screed raking device of claim 1, wherein the rake handle attaching means comprising:

(a) a tubular attaching arm extending perpendicularly away from the screed back;

(b) the tubular rake handle sliding snugly and freely over the tubular attaching arm and against the screed back at the opposing rake handle attaching end; and (c) at least one handle securing hole operatively projecting simultaneously through the tubular rake handle and the tubular attaching arm, allowing at least one handle securing bolt to secure the tubular rake handle to the tubular attaching arm with at least one handle securing nut.

4. The hand held screed raking device of claim 1, wherein the underside shoe further comprising:

(a) the underside shoe freely, securely, and removably attaching against the angular bottom plate of the longitudinally extending screed head by an at least one shoe attaching means;

(b) a screed head cooperating heel securing notch locating immediately and vertically above the shoe back end, the screed head cooperating heel securing notch removably and securely housing a removable shoe heel wear protective surface strip; and (c) wherein the shoe heel wear protective surface strip is selected from a group consisting of plastic, metal carbide, magnesium, titanium, or other lightweight and wear resistant material.

5. The hand held screed raking device of claim 1, wherein the tubular rake handle comprising: non-conductive, lightweight, and resilient material.

6. The hand held screed raking device of claim 1, wherein the longitudinal bottom trailing surface comprising one of: a smooth bottom surface or a textured bottom surface.

7. The hand held screed raking device of claim 1, wherein the longitudinally extending screed head further comprising: an interior flange support locating centrally within a hollow interior and attaching from the arc/bottom contact point to midway along the screed back.

8. The longitudinal bottom trailing surface of claim 6, wherein the textured bottom surface comprising:

(a) comprising at least one of: a wave form bottom surface, a v-shaped bottom surface, a block shaped bottom surface, or other form of textured bottom surface;

(b) comprising one of: a repetitive form or a variable form; and (c) orienting to the applying direction as one of: parallel, perpendicular, or at an acute angle.

9. The longitudinal bottom trailing surface of claim 6, wherein the textured bottom surface flattening and dampening in amplitude from the opposing shoe toe securing end to the shoe back end.

10. The hand held screed raking device of claim 1, the longitudinally extending screed head further comprising at least one of: aluminum, plastic, or other durable and lightweight material.

11. A hand held screed raking device of claim 1, said device further comprising: a pair of opposing end caps securely attaching to the pair of opposing screed head ends.

12. The underside shoe of claim 4, wherein the at least one shoe attaching means comprising:

an at least one attaching bolt threading upwardly through an at least one shoe hole located in the longitudinal bottom trailing surface and into an at least one threaded tapped bottom hole located in the angular bottom plate and cooperatively corresponding with the at least one shoe hole, thereby securing and attaching the underside shoe to the longitudinally extending screed head.

13. The hand held screed raking device of claim 1, wherein the application material is selected from a group consisting of glue laminates, asphalt, cement, tile and floor grout, mortar, landscaping topsoil, gravel, aggregate, mulch, dirt, or other surface treatment material.

14. A hand held screed raking device, said device comprising:

(a) a longitudinally extending screed head comprising:

(i) a convexly arced dozer front face, a screed back, and a longitudinal bottom trailing surface;

(ii) the convexly arced dozer front face acutely connecting to and terminating downwardly at the longitudinal bottom trailing surface at an arc/bottom contact point and oppositely and acutely upwardly connecting to the screed back at an arc/back contact point;

(iii) the longitudinal bottom trailing surface oppositely and acutely connecting to the screed back at a back/bottom contact point, thereby the convexly arced dozer front face, the screed back, and the longitudinal bottom trailing surface forming a generally triangular cross sectional shape to the longitudinally extending screed head; and (iv) the convexly arced dozer front face arcing downward to the arc/bottom contact point; and (b) a rake grip handle securely attaching to the longitudinally extending screed head midway vertically down and centrally on the screed back between the back/bottom point and the arc/back contact point.

15. The hand held screed raking device of claim 14, wherein the longitudinal bottom trailing surface comprising one of: a smooth bottom surface or a textured bottom surface.

16. The longitudinal bottom trailing surface of claim 15, wherein the textured bottom surface comprising:

(a) comprising at least one of: a wave form bottom surface, a v-shaped bottom surface, a block shaped bottom surface, or other form of textured bottom surface;

(b) comprising one of: a repetitive form or a variable form; and (c) orienting to the applying direction as one of: parallel, perpendicular, or at an acute angle.

17. The longitudinal bottom trailing surface of claim 15, wherein the textured bottom surface flattening and dampening in amplitude from the arc/bottom contact point to the back/bottom contact point.

18. The hand held screed raking device of claim 14, the longitudinally extending screed head further comprising at least one of: aluminum, plastic, or other durable and lightweight material.

19. The hand held screed raking device of claim 14, wherein the application material is selected from a group consisting of glue laminates, asphalt, cement, tile and floor grout, mortar, landscaping topsoil, gravel, aggregate, mulch, dirt, or other surface treatment material.

20. The hand held screed raking device of claim 14, wherein the rake grip handle comprising:

non-conductive, lightweight, and resilient material.

21. The hand held screed raking device of claim 14, wherein the rake grip handle comprising:

an opened grip rake handle.

22. A hand held screed raking device, said device comprising:

(a) a longitudinally extending screed head comprising:

(i) an upper head portion, an arced dozer front face, a screed back, an angularly attached bottom plate, and a pair of opposing screed head ends;

(ii) the arced dozer front face comprising one of: a concavely arced face or a convexly arced face;

(iii) the arced dozer front face acutely and downwardly connecting to the angular bottom plate at an arc/bottom contact point, terminating at a screed head cooperating toe securing end, and oppositely and acutely, upwardly connecting to the screed back at an arc/back contact point;

(iv) the upper head portion locating above and attaching to the arced dozer front face and the screed back at the arc/back contact point;

(v) the angular bottom plate acutely connecting oppositely from the arc/back contact point to the screed back at a back/bottom contact point, thereby the arced dozer front face, the screed back, and the angular bottom plate forming a generally triangular cross sectional shape to the longitudinally extending screed head;

(vi) an underside shoe comprising: an upwardly angled leading surface, a shoe back end and an opposing shoe toe securing end; and (vii) the underside shoe connecting with and abutting against the arced dozer front face at the screed head cooperating toe securing end with the opposing shoe toe securing end, conformably and cooperatively securing against the angular bottom plate, and arcing downward and rearward, connecting to a longitudinal bottom trailing surface, the longitudinal bottom trailing surface continuing rearward laterally and terminating at the shoe back end;

(b) a tubular rake handle comprising a rake handle free end and an opposing rake handle attaching end;

(c) the longitudinally extending screed head further comprising: a rake handle attaching means locating centrally on the arced dozer front face midway between the arc/back contact point and the arc/bottom contact point and freely securing the tubular rake handle; and (d) the tubular rake handle freely and securely attaching to and engaging the longitudinally extending screed head by the rake handle attaching means proximal to the opposing rake handle attaching end.

23. The hand held screed raking device of claim 22, wherein the rake handle attaching means comprising:

(a) a tubular attaching arm extending perpendicularly away from the arced dozer front face;

(b) the tubular rake handle sliding snugly and freely over the tubular attaching arm and against the arced dozer front face at the opposing rake handle attaching end; and (c) at least one handle securing hole operatively projecting simultaneously through the tubular rake handle and the tubular attaching arm, allowing at least one handle securing bolt to secure the tubular rake handle to the tubular attaching arm with at least one handle securing nut.

24. The hand held screed raking device of claim 22, wherein the longitudinal bottom trailing surface comprising one of: a smooth bottom surface or a textured bottom surface.

25. The longitudinal bottom trailing surface of claim 24, wherein the textured bottom surface comprising:

(a) comprising at least one of: a wave form bottom surface, a v-shaped bottom surface, a block shaped bottom surface, or other form of textured bottom surface;

(b) comprising one of: a repetitive form or a variable form; and (c) orienting to the applying direction as one of: parallel, perpendicular, or at an acute angle.

26. The longitudinal bottom trailing surface of claim 24, wherein the textured bottom surface flattening and dampening in amplitude from the opposing shoe toe securing end to the shoe back end.

27. The hand held screed raking device of claim 22, wherein the underside shoe further comprising:

(a) the underside shoe freely, securely, and removably attaching against the angular bottom plate of the longitudinally extending screed head by an at least one shoe attaching means; and (b) the at least one shoe attaching means comprising: an at least one attaching bolt threading upwardly through an at least one shoe hole located in the longitudinal bottom trailing surface and into an at least one threaded tapped bottom hole locating in the angular bottom plate and cooperatively corresponding with the at least one shoe hole, thereby securing and attaching the underside shoe to the longitudinally extending screed head.

* * * * *